US007092666B2

(12) United States Patent
Hung et al.

(10) Patent No.: US 7,092,666 B2
(45) Date of Patent: Aug. 15, 2006

(54) ROLLER MECHANISM FOR SEPARATING PAPER

(75) Inventors: Ming Te Hung, Pan Chiao (TW); Kung-Hsin Teng, Ping Jen (TW)

(73) Assignee: Lite-On Technology Corporation, Taipei (TW)

( * ) Notice: Subject to any disclaimer, the term of this patent is extended or adjusted under 35 U.S.C. 154(b) by 130 days.

(21) Appl. No.: 10/825,312

(22) Filed: Apr. 16, 2004

(65) Prior Publication Data

US 2005/0042002 A1 Feb. 24, 2005

(30) Foreign Application Priority Data

Aug. 22, 2003 (TW) ..... 92215304 U

(51) Int. Cl.
*G03G 15/20* (2006.01)
*B65H 29/54* (2006.01)

(52) U.S. Cl. ..... 399/323; 271/307; 271/900

(58) Field of Classification Search ..... 399/22, 399/320–323, 397–400; 271/307, 308, 311–313, 271/900

See application file for complete search history.

(56) References Cited

U.S. PATENT DOCUMENTS 3,824,011 A * 7/1974 Suzuki et al. ..... 399/398
6,137,982 A * 10/2000 Margiotta ..... 399/323

* cited by examiner

*Primary Examiner*—Arthur T. Grimley
*Assistant Examiner*—Ryan Gleitz
(74) *Attorney, Agent, or Firm*—Birch, Stewart, Kolasch, and Birch, LLP

(57) ABSTRACT

A roller mechanism for separating paper has a fusing roller, a following roller, and at least two paper-separating rings. The fusing roller is formed with at least two annular grooves on a periphery thereof. The two paper-separating rings are respectively mounted in the annular grooves correspondingly. The following roller is contiguous to the fusing roller for heating a paper therebetween and transporting out the paper smoothly.

11 Claims, 4 Drawing Sheets

ROLLER MECHANISM FOR SEPARATING PAPER

This Nonprovisional application claims priority under 35 U.S.C. § 119(a) on patent application Ser. No(s). 92215304 filed in TAIWAN on Aug. 22, 2003, the entire contents of which are hereby incorporated by reference.

BACKGROUND OF THE INVENTION

1. Field of the Invention

The present invention relates to a roller mechanism for separating paper, and particularly to a roller mechanism applied in a business machine (for example, a laser printer, or a copy machine) for transporting out paper smoothly.

2. Description of the Prior Art

The operating principle of all the laser printer or copy machine, referring to the FIG. 1, is making a paper (P) absorbed carbon powder via electric charge, and making the carbon powder fused on the paper (P) by heating via a heating mechanism (H). The heating mechanism (H) is mounted in a fusing roller 2*a*. A follower roller 3*a* which is assembled under the fusing roller 2*a* exerts pressure upon another surface of the paper (P). Because of the carbon powder, the paper (P) will easily adhere to the fusing roller 2*a* when the fusing roller 2*a* heats the paper (P). Therefore, it needs a paper-separating mechanism for separating the paper (P) from the fusing roller 2*a*.

The fusing roller 2*a* of prior art comprises a pivoting device 4*a* which is disposed adjacent a paper outlet 5*a*, and a plurality of separating claws 6*a* which are pivoted on an end of the pivoting device 4*a*. The separating claws 6*a* are respectively formed with a sharp tip, and the sharp tips are contact with the surface of the fusing roller 2*a*. When the paper (P) passes the fusing roller 2*a*, the separating claws 6*a* separates the paper (P) from the fusing roller 2*a*, and the paper (P) is guided along the separating claws 6*a* to the paper outlet 5*a*.

However, the separating claws 6*a* of the prior art must be disposed accurately, each of the separating claws 6*a* must closes to the surface of the fusing roller 2*a* accurately. If one of the separating claws 6*a* is not closed, the paper (P) will probably adhere to the fusing roller 2*a* and roll thereon, even the paper (P) will wrap around the fusing roller 2*a*. At that time, it usually need to dismantle a rear panel of the laser printer and take the paper (P) out carefully to avoid injuring the separating claws 6*a* and the fusing roller 2*a*. Besides, it must consider particularly the material of the separating claws 6*a* for withstanding high temperature and not injuring the fusing roller 2*a*. Therefore the cost and accurateness requirement of the prior art are high.

Hence, an improved roller mechanism for separating paper is required to overcome the disadvantages of the prior art.

SUMMARY OF THE INVENTION

An object of the present invention is to provide a paper-separating roller mechanism which is applied in business machine for simplifying structure and for assuring paper transported smoothly after image formed on the paper.

In order to achieve the above objects, the present invention according to one aspect thereof provides a roller mechanism for separating paper. The roller mechanism comprises a fusing roller formed with at least two annular grooves on a periphery thereof; at least two paper-separating rings respectively mounted in the annular grooves correspondingly; and a following roller contiguous to the fusing roller.

Further scope of the applicability of the present invention will become apparent form the detailed description given hereinafter. However, it should be understood that the detailed description and specific examples, while indicating preferred embodiments of the invention, are given by way of illustration only, since various change and modifications within the spirit and scope of the invention will become apparent to those skilled in the art from this detailed description.

BRIEF DESCRIPTION OF THE DRAWINGS

The invention will be better understood and objects other than those set forth above will become apparent when consideration is given to the following detailed description thereof. Such a description makes reference to the annexed drawings wherein.

DESCRIPTION OF THE PREFERRED EMBODIMENT

Figure 1:
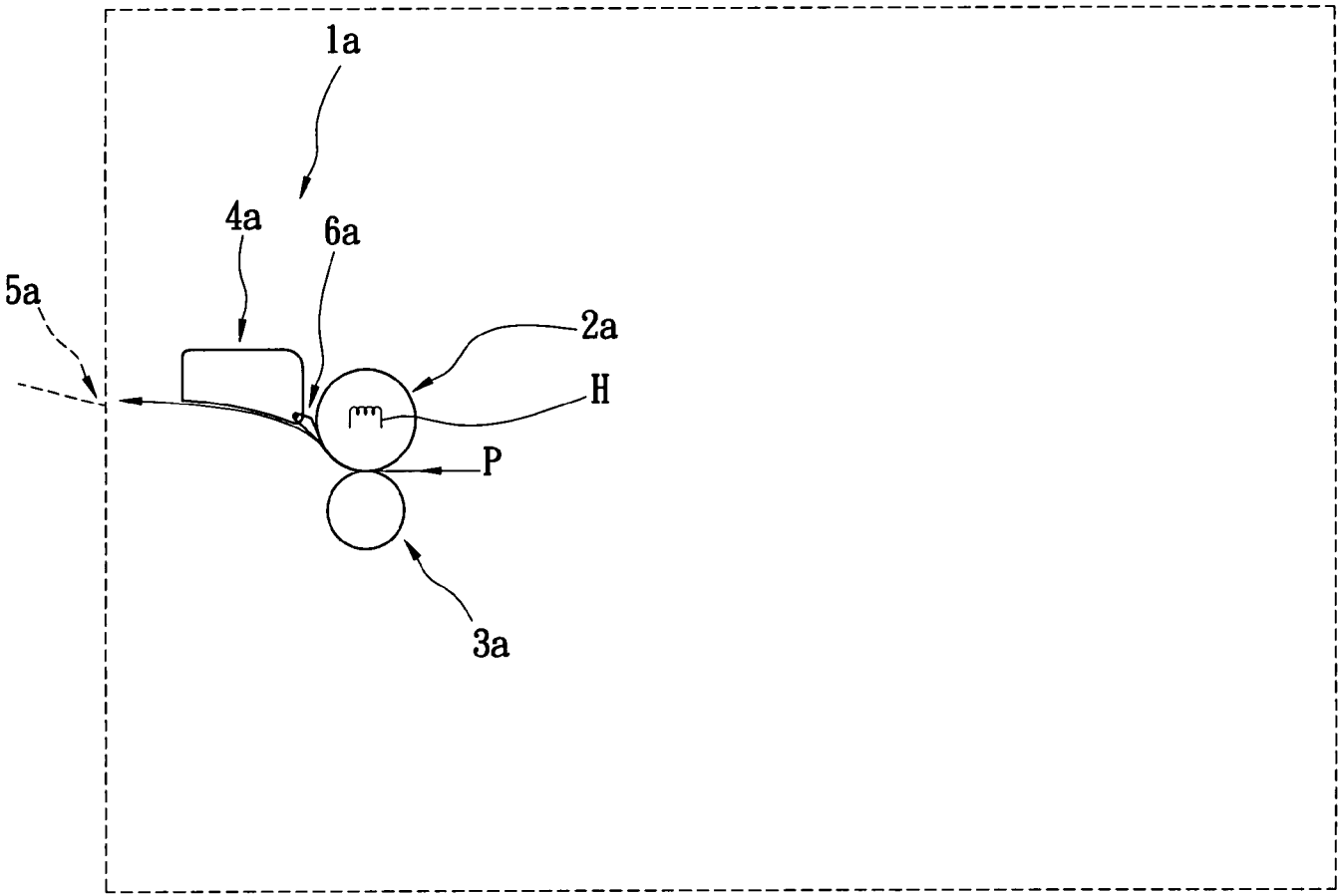
FIG. 1 PRIOR ART
FIG. 1 is a side view of a paper-separating mechanism of prior art.
Figure 2:
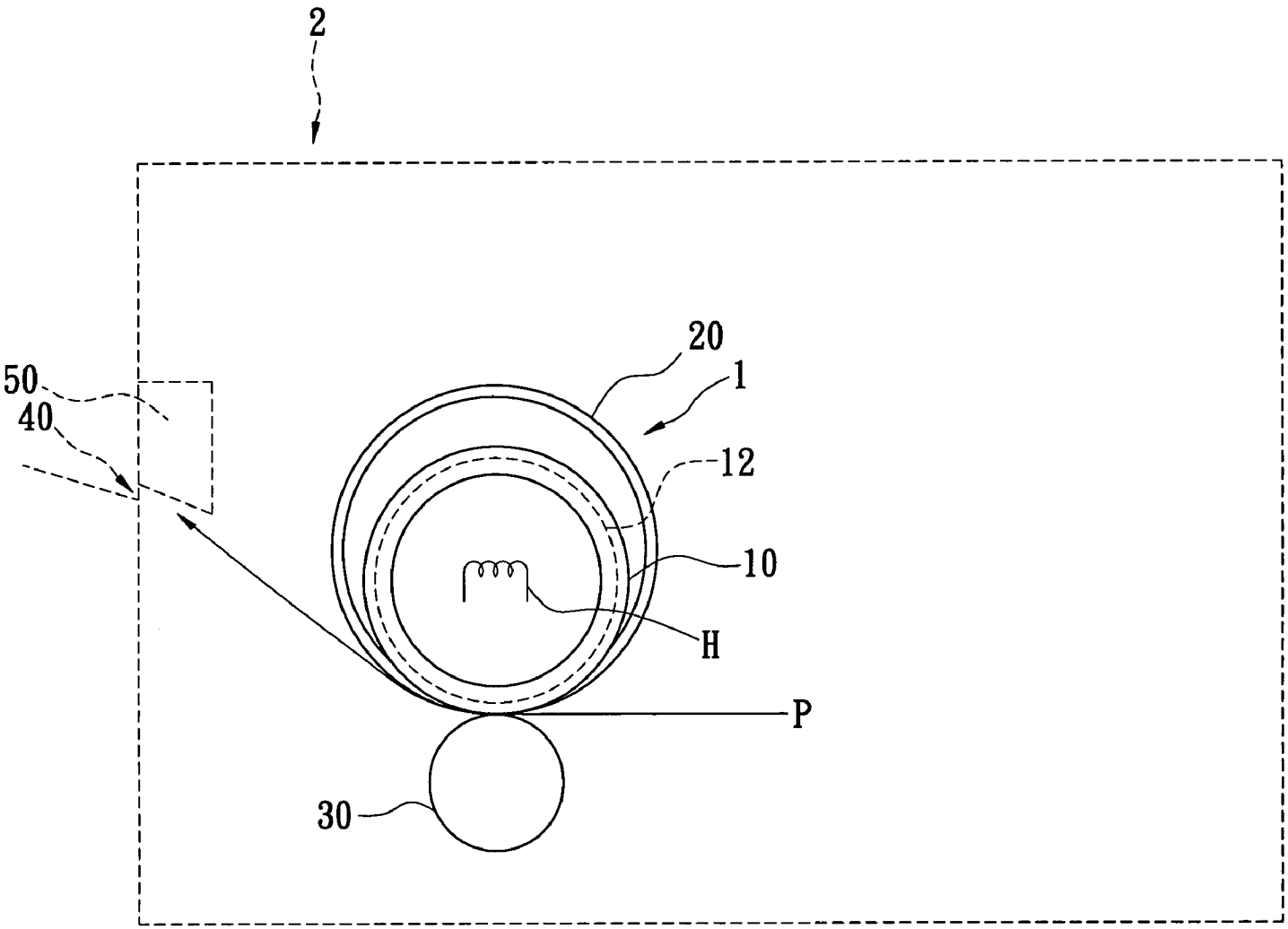
FIG. 2 is a side view of a paper-separating mechanism of the invention.

Referring to FIG. 2, it is a side-view of the present invention of the paper-separating mechanism. The roller mechanism 1 is mounted in a business machine 2, and adjacent to an paper outlet 40. The paper outlet 40 has a guiding mechanism 50. The business machine 2 could be a laser printer, copy machine, or any machine that need a paper-separating mechanism.

The paper-separating mechanism comprises a fusing roller 10 which is assembled with a heat mechanism (H) therein for heating the fusing roller 10, and a following roller 30 which is mounted under the fusing roller 10. The fusing roller 10 and the following roller 30 are contiguous to each other and respectively rotating along the center of a circle thereof. Therefore, after transporting a paper (P) through the fusing roller 10, the carbon powder that has been absorbed on the paper will fuse on the paper (P).

The fusing roller 10 is formed with at least two annular grooves 12 on a periphery thereof. At least two paper-separating rings 20 are respectively mounted in the corresponding annular grooves 12. The annular grooves 12 are parallel and formed along diameter-paths of the fusing roller 10, and have the same cross-section. The surface of the paper-separating rings 20 is coplanar with the surface of the fusing roller 10 after the paper-separating rings 20 are assembled in the annular grooves 12. A diameter of the paper-separating ring 20 is lager than that of the fusing roller 10.

The following roller 30 can be assembled above the fusing roller 10, so the paper-separating rings 20 will hang down on the fusing roller 10 naturally by gravity and do not need too much width.

Figure 3:
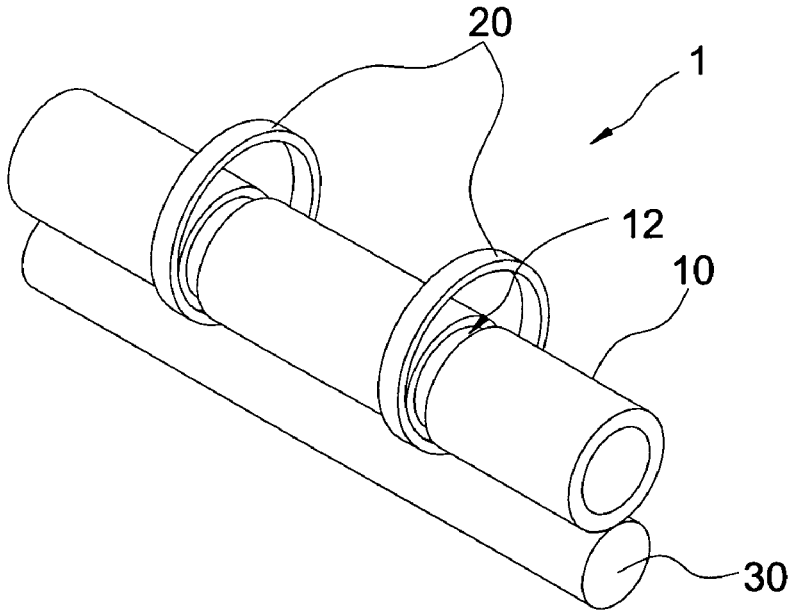
FIG. 3 is a perspective view of the first embodiment of annular groove and a paper-separating ring.

Referring to the FIG. 3, which is a first embodiment of the annular groove and paper-separating ring of the present invention. The cross-section of the annular groove 20 along a diameter thereof could be a rectangular groove, and the cross-section of the paper-separating ring 20 along its diameter is mating with the rectangular groove.

Figure 4:
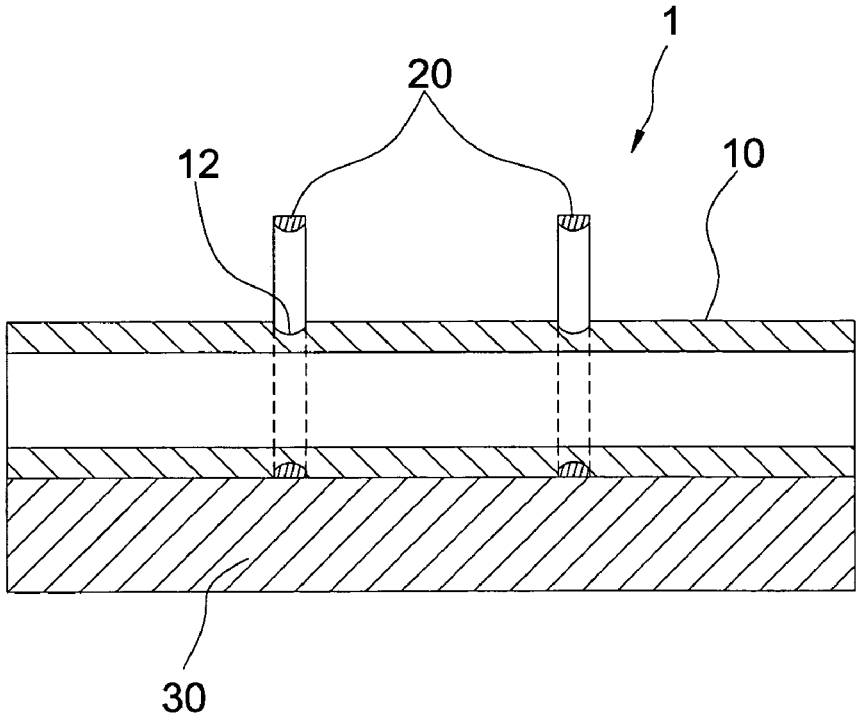
FIG. 4 is a perspective view of another embodiment of the annual groove and the paper-separating ring.

Referring to the FIG. 4, which is another embodiment of the annular groove and paper-separating ring. The cross-section of the annular groove 20 along a diameter thereof could be a curve groove, and the cross-section of the paper-separating ring 20 along a diameter thereof is mating with the curve groove.

Figure 4A:
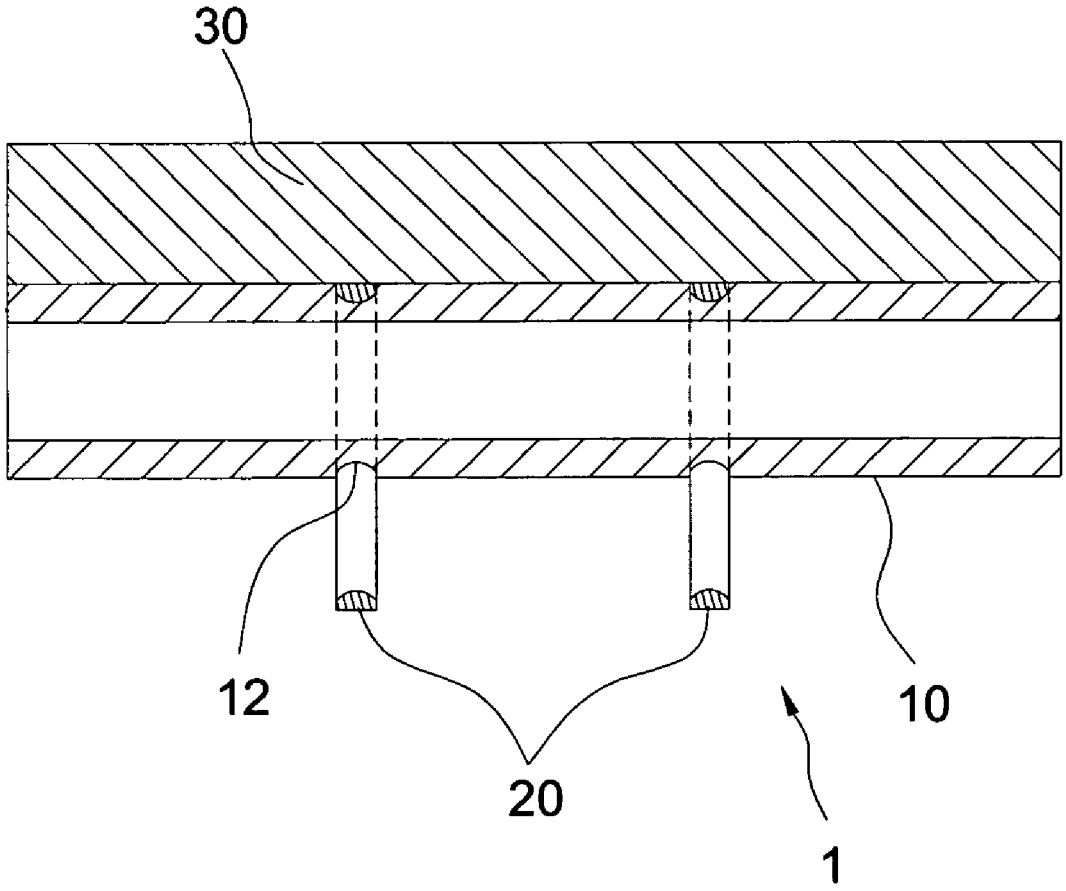
FIG. 4A is a perspective view similar to FIG. 4, but showing another embodiment with the following roller above the fusing roller.

FIG. 4A shows another embodiment with the following roller 30 assembled above the fusing roller 10.

Wherein the paper-separating rings 20 are made of heat-conductible material.

By the above describing, it is manifest that the present invention simplifying the paper-separating mechanism of the prior art. By means of the annular paper-separating rings, the paper is easily and assuredly to separate from the fusing roller. The structure of the paper-separating ring is simple and easily to manufacture, it is obvious to reduce the manufacturing cost. In any case, the paper is certain to separate from the fusing roller, and effectively reduce the failure rate. In the prior art, if any one of the separating claw is not contiguous to the fusing roller, the paper will roll up and adhere to the surface of the fusing roller.

It is to be understood, however, that even though numerous characteristics and advantages of the present invention have been set forth in the foregoing description, together with details of the structure and function of the invention, the disclosure is illustrative only, and changes may be made in detail, especially in matter of shape, size, and arrangement of parts within the principles of the invention to the full extent indicated by the broad general meaning of the terms in which the appended claims are expressed.

What is claimed is:

1. A roller mechanism for separating paper comprising:

a fusing roller formed with at least two annular grooves on a periphery thereof;

at least two paper-separating rings respectively mounted in the annular grooves correspondingly; and a following roller contiguous to the fusing roller.

2. The roller mechanism for separating paper as in claim 1, wherein the annular grooves are formed parallel to each other and along diameter paths of the fusing roller.

3. The roller mechanism for separating paper as in claim 1, wherein a surface of the paper-separating ring is coplanar with a surface of the fusing roller.

4. The roller mechanism for separating paper as in claim 3, wherein a diameter of the paper-separating ring is lager than that of the fusing roller.

5. The roller mechanism for separating paper as in claim 3, wherein a cross-section of the annular groove along a diameter thereof is a rectangular groove, and a cross-section of the paper-separating ring along a diameter thereof is mating with the rectangular groove.

6. The roller mechanism for separating paper as in claim 3, wherein a cross-section of the annular groove along a diameter thereof is a curve groove, and a cross-section of the paper-separating ring along a diameter thereof is mating with the curve groove.

7. The roller mechanism for separating paper as in claim 1, wherein the paper-separating rings are made of heat-conductible material.

8. A business machine with paper-separating mechanism, the business machine comprising:

a paper outlet;

a paper-separating mechanism assembled therein and adjacent the paper outlet, having:

a fusing roller formed with at least two annular grooves on a periphery thereof;

at least two paper-separating rings respectively mounted in the annular grooves correspondingly; and a following roller contiguous to the fusing roller.

9. The business machine with paper-separating mechanism as in claim 8, wherein the annular grooves are parallel and formed along a diameter path of the fusing roller, and a diameter of the paper-separating ring is lager than that of the fusing roller.

10. The business machine with paper-separating mechanism as in claim 8, wherein a cross-section of the annular groove along a diameter thereof is mating with that of the fusing roller, and a surface of the paper-separating ring is level with a surface of the fusing roller.

11. The business machine with paper-separating mechanism as in claim 8, wherein the following roller is assembled above the fusing roller.

* * * * *